US007669992B2

(12) United States Patent
Watanbe

(10) Patent No.: US 7,669,992 B2
(45) Date of Patent: Mar. 2, 2010

(54) LIQUID CONTAINER AND INKJET RECORDING APPARATUS

(75) Inventor: Shigeru Watanbe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 707 days.

(21) Appl. No.: 11/469,809

(22) Filed: Sep. 1, 2006

(65) Prior Publication Data

US 2007/0058012 A1 Mar. 15, 2007

(30) Foreign Application Priority Data

Sep. 13, 2005 (JP) ..... 2005-265509

(51) Int. Cl.
*B41J 2/175* (2006.01)

(52) U.S. Cl. ..... 347/86

(58) Field of Classification Search ..... 347/6, 347/85–87

See application file for complete search history.

(56) References Cited

U.S. PATENT DOCUMENTS 6,824,258 B2 11/2004 Yamamoto et al.
2002/0122103 A1* 9/2002 Yamamoto et al. ..... 347/85
2004/0100540 A1 5/2004 Yamamoto et al.

FOREIGN PATENT DOCUMENTS

| | | | |
|---|---|---|---|
| JP | 54-139535 | * 10/1979 | ..... 347/85 |
| JP | 2001-270131 | 10/2001 | |
| JP | 2002-19137 | 1/2002 | |
| JP | 2004-175417 | 6/2004 | |
| JP | 2005-007855 | 1/2005 | |

* cited by examiner

*Primary Examiner*—Julian D Huffman
(74) *Attorney, Agent, or Firm*—Canon USA Inc IP Div

(57) ABSTRACT

A recording apparatus having a diaphragm valve disposed between an ink tank and a recording head, in which closing and opening the valve produces a flow of ink. The ink tank includes two independent connection ports adjacent to one end at the bottom and a structure being configured to restrict an upward flow of ink and being located above the connection ports. Restricting the upward flow allows a small amount of ink flowing in and out to produce an entire flow of ink within the ink tank. Therefore, variations in concentration caused by precipitation of ink can be reduced.

8 Claims, 12 Drawing Sheets

LIQUID CONTAINER AND INKJET RECORDING APPARATUS

BACKGROUND OF THE INVENTION

1. Field of the Invention

The present invention relates to a liquid container capable of accommodating pigment ink therein and to an inkjet recording apparatus that supplies the ink from the liquid container to a recording head via a tube or another member.

2. Description of the Related Art

Inkjet printing is a printing method that forms an image by spraying a single-color ink or inks of different colors prepared for color printing onto a print medium (e.g., paper or transparency film). A recording apparatus using this inkjet printing method includes a liquid container (ink tank) as a cartridge in the vicinity of a print head on a carriage, the liquid container being integral with or separate from the print head. When the ink has run out in the liquid container, the cartridge is replaced with a new one to restock ink. This cartridge replacement type is the most popular inkjet printer type.

However, the cartridge replacement type has a limitation of providing an ink tank on a carriage up to a certain size. If a large ink tank is provided to reduce the frequency of replacement of the ink tank, a space occupied by the ink tank is significantly large. This increases the size of a recording apparatus and the power required to move the carriage. As a result, a very large power source is required, and other various problems arise.

Thus, in a large recording apparatus that is called a wide format printer, an ink tank having sufficient capacity is detachably mounted on a securing point of the printer. In that printer, supplying ink to a recording head on a carriage through a tube connected to the recording head using a pump is a typical system.

Business-grade recording apparatuses such as wide format printers need to use pigment ink with excellent resistances to water and light. However, the pigment ink has a problem in which pigment precipitates on the bottom of the ink tank when it is left standing for a long time and thus ink concentration varies depending on the location within the ink tank. In particular, variations in concentration are apt to increase with the volume of ink within the ink tank and with the height relative to the base area. For a recording apparatus such as a wide format printer, a significantly large ink tank capacity is desired in order to reduce running costs, and in the case of pigment ink, concentration variations are a very serious problem that might decrease image quality.

One known approach to the problem of concentration variations is an arrangement discussed in U.S. Pat. No. 6,824,258. In this arrangement, the bottom of an ink tank is provided with a first connection port for connection with a main body of an apparatus and for use in supplying ink to a recording head and a second connection port for connection with an air communication chamber and for use in introducing air from atmosphere, these two connection ports are disposed adjacent to an end of the bottom of the ink tank, and the inside of the ink tank is agitated by the introduction of bubbles from the communication unit connected to the atmosphere.

Another known approach is an arrangement discussed in Japanese Patent Laid-Open No. 2002-019137 in which the inside of an ink tank is agitated by the introduction and ejection of ink using a pump.

A known method of agitating precipitated ink using bubbles is described with reference to FIGS. 9 to 11, and a known method of agitating precipitated ink using the introduction and ejection of ink is described with reference to FIG. 12.

FIG. 9 is a schematic diagram of an ink supply route for explaining a known method of agitating precipitated ink using bubbles.

An ink tank 1 detachably mounted on a main body of an inkjet recording apparatus includes two independent connection ports for connection with the main body at the bottom. Each of the two connection ports is formed from a sealant. The inkjet recording apparatus includes connection ports 5 (5*a* and 5*b*), each of which is formed from a hollow tube. The first connection port 5*a* is adjacent to an end of the ink tank 1 and communicates with a recording head 2 through a supply tube 4. Ink is supplied from the ink tank 1 to the recording head 2 through the first connection port 5*a*. An ink supply valve 3 is located within the ink supply route. Opening and closing the ink supply valve 3 enables and disables the supply of ink to the recording head 2. The second connection port 5*b* communicates with an air communication chamber 6. Air introduced from an air communication port 7 is introduced into the ink tank 1 through the second connection port 5*b*. Ink is ejected from the ink tank 1 and the internal pressure of the ink tank 1 is thus reduced, thereby introducing air into the ink tank 1 from the air communication port 7 and thus relieving the internal pressure of the ink tank 1. When the temperature inside the ink tank 1 is increased, air inside the ink tank 1 is expanded, the internal pressure of the ink tank 1 is increased, and ink is ejected from the second connection port 5*b* to the air communication chamber 6. The air communication chamber 6 has a capacity corresponding to the expansion of air inside the ink tank 1. When ink is discharged from the recording head 2 and consumed, ink stored in the air communication chamber 6 is first consumed, and ink in the ink tank 1 is then consumed.

FIGS. 10A to 10C illustrate how a uniform concentration distribution of pigment ink in the ink tank at the initial stage is changed after the ink tank is left standing.

FIGS. 10A and 10B illustrate how a uniform concentration distribution of ink in the ink tank at the time of attachment of the ink tank is changed after the ink tank is left standing. FIG. 10C is a diagram for explaining the structure of concentration distribution. As shown in FIG. 10B, when the ink tank 1 which stores pigment ink is left standing for a predetermined period of time, an ink ingredient distributed in the ink (e.g., pigment) precipitates downward vertically with time. As a result, the concentration of pigment ink at a lower part of the ink tank 1 is increased, and the concentration of pigment ink at an upper part of the ink tank 1 is reduced accordingly. At an intermediate part of the ink tank 1, an appropriate concentration of pigment ink is formed. Therefore, the uniform concentration is changed to a three-layer concentration distribution. As the time for which the ink tank is left standing is increased, the concentration of highly concentrated ink at the lower part of the ink tank 1 is increased, and the amount thereof is also increased. The concentration at the upper part is reduced accordingly. As the height of the ink tank 1 relative to the base area is increased, the concentration and the amount of the highly concentrated ink at the lower part of the ink tank 1 caused by being left standing is increased.

When air is introduced into the ink tank 1, the air forms bubbles, and the bubbles flow toward the top of the ink tank 1 due to their buoyancy. Since the second connection port (air introduction port) 5*b* of the ink tank 1 is disposed adjacent to an end of the bottom of the ink tank 1, a flow of ink is generated in the ink tank 1, as shown in FIG. 11, and the ink inside the ink tank 1 with the three-layer concentration distribution is thus agitated. As a result, the concentration is rendered uniform.

FIG. 12 is a diagram for explaining a method of agitating precipitated ink by causing ink to be introduced into and ejected from an ink tank and thus producing a flow of ink inside the ink tank using a pump.

An ink tank 1 detachably mounted on a main body of an inkjet recording apparatus includes three independent connection ports 5*a*, 5*b*, and 5*c* for connection with the main body at the bottom. Each of the three connection ports is formed from a sealant. The inkjet recording apparatus includes connection ports 5*a*, 5*b*, and 5*c*, each of which is formed from a hollow tube. The first connection port 5*a* communicates with a recording head 2 via a supply tube 4 and allows ink to be supplied to the recording head 2. The second connection port 5*b* communicates with an air communication port 7 and allows air introduced from the air communication port 7 to be introduced into the ink tank 1. The third connection port 5*c* communicates with a pump 400 constructed of a diaphragm and allows ink to be introduced into the ink tank 1 through an ink path 325 and ejected from the ink tank 1 by the driving of the pump 400. Ink flowing in and out of the ink tank 1 changes air pressure within the ink tank 1. As a result, ink is extruded into the air communication port 7 from the second connection port 5*b*, which is connected to the air communication port 7. During this time, the ink does not virtually flow toward the recording head 2 because channel resistance is large. Ink flowing in and out of the ink tank 1 produces a flow within the ink tank 1, thus allowing precipitated ink to be agitated.

However, for the exemplary agitation method using bubbles described above, if ink is not consumed, air is not introduced into the ink tank and thus agitation effect is not obtained. Therefore, to achieve an increased effect of agitation, a problem arises in which a large amount of ink has to be wasted.

Additionally, because highly concentrated ink is first supplied toward the recording head, an image quality with uniform concentration cannot be obtained unless all the highly concentrated ink is discarded. In this case, a problem arises in which the concentration of ink remaining in the ink tank after the ink is agitated is smaller than the previous concentration.

For the exemplary agitation method by producing a flow of ink within the ink tank, it is necessary to change the amount of ink flowing into and out of the ink tank depending on the amount of ink within the ink tank. Therefore, if the amount of ink is large, it is necessary to have a large amount of ink flowing in and out of the ink tank. This requires not only a large space for holding a large amount of ink at an air communication side but also a large power source for driving a pump. As a result, a problem arises as to the size of the main body of the apparatus and the cost.

The inventor of the present invention conducted an experiment on agitation of the inside of an ink tank having a base area of approximately 60 mm×24 mm and a capacity of 130 ml by only introduction and ejection of ink. The result shows that the amount of ink flowing in and out of the ink tank required to agitate ink within the ink tank is approximately 10 ml, and a very large pump structure and a very large power source are needed.

SUMMARY OF THE INVENTION

The present invention is directed to a liquid container and a recording apparatus allowing the acquisition of a satisfactory image by efficiently agitating ink stored in the liquid container and reducing variations in concentration of the liquid occurring after the liquid container is left standing for a long period of time using an inexpensive structure.

According to a first aspect of the present invention, a liquid container capable of being detachably mounted on an inkjet recording apparatus including a liquid supply tube facilitating supplying liquid to the liquid container, an air introduction tube facilitating introducing air to the liquid container, and a valve configured to introduce ink into and eject ink from the liquid container by enabling and disabling ink communication along a communication path in the liquid supply tube is provided. The liquid container includes a liquid storage chamber configured to store recording liquid containing pigment, a liquid supply unit disposed at a bottom of the liquid storage chamber and adjacent to a first side of the liquid storage chamber in a state in which the liquid container is used, the liquid supply unit being connectable to the liquid supply tube, an air introduction unit disposed at the bottom of the liquid storage chamber and connectable to the air introduction tube, and a structure configured to restrict an upward flow of ink introduced into the liquid storage chamber from the liquid supply unit toward the first side, the structure being disposed in a direction that intersects a vertical direction.

According to a second aspect of the present invention, an inkjet recording apparatus includes a recording head configured to discharge ink and perform recording, a liquid supply tube facilitating supplying liquid to a liquid storage chamber, an air introduction tube facilitating introducing air so as to replace liquid to be supplied, a liquid container detachably mounted on the inkjet recording apparatus, the liquid container storing ink containing pigment in the liquid storage chamber, the liquid container including a liquid supply unit connected to the liquid supply tube and an air introduction unit connected to the air introduction tube, and a valve configured to introduce ink into and eject ink from the liquid container by enabling and disabling ink communication along a communication path in the liquid supply tube. The liquid container further includes a structure configured to restrict an upward flow of ink introduced by the valve into the liquid storage chamber toward a first side of the liquid storage chamber, the structure being disposed in a direction that intersects a vertical direction.

Since a flow of ink diffuses precipitated ink efficiently, there is no need to waste ink. Additionally, since highly concentrated ink is not discarded, the overall concentration of ink within the ink tank is not reduced. Controlling an upward flow of ink using a structure for restricting a flow of ink disposed on the ink tank enables a small amount of ink flowing in and out the ink tank to diffuse precipitated ink. This can reduce the load on a driving source and a space for temporarily holding ink. As a result, the size of the main body of the apparatus can be reduced, and the cost can be suppressed.

Further features of the present invention will become apparent from the following description of exemplary embodiments with reference to the attached drawings.

DESCRIPTION OF THE EMBODIMENTS

Exemplary embodiments of the present invention are described below with reference to the accompanying drawings.

Figure 1:
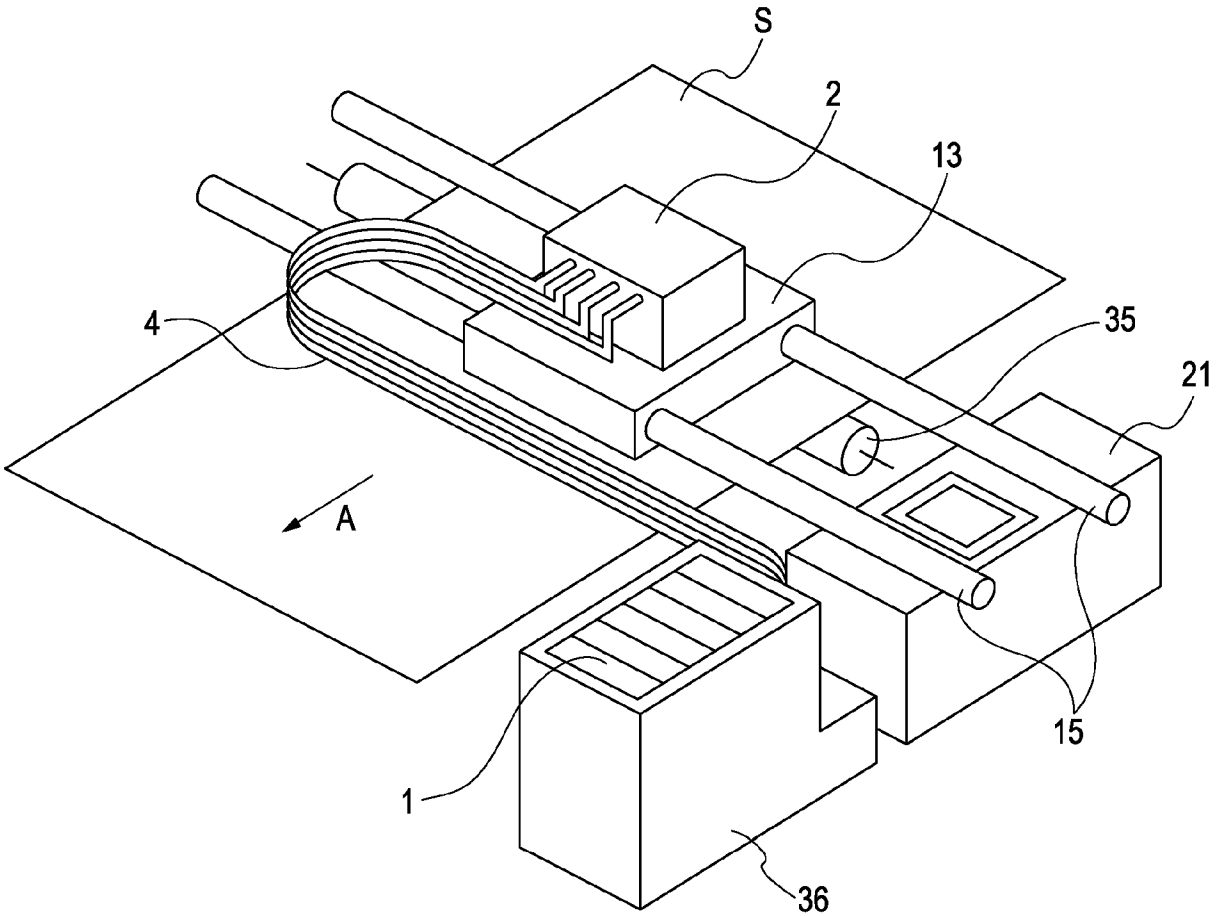
FIG. 1 is a perspective view of an inkjet recording apparatus according to a first exemplary embodiment of the present invention.

FIG. 1 is a perspective view of an inkjet recording apparatus according to a first exemplary embodiment of the present invention. The inkjet recording apparatus illustrated in FIG. 1 repeats a reciprocating movement of a recording head 2 (main scanning) and a conveyance movement of a recording medium S (e.g., plain paper, specialty paper, and transparency film) by a predetermined pitch (sub scanning). In synchronization with these movements, the inkjet recording apparatus selectively discharges ink from the recording head 2 and deposits the ink onto the recording medium S to create a letter, a symbol, and an image. The inkjet recording apparatus is of a serial type.

In FIG. 1, the recording head 2 is detachably mounted on a carriage 13. The carriage 13 is slidably supported on two guide rails 15 and is reciprocated along the guide rails 15 by a driving unit (e.g., motor) (not shown). The recording medium S is conveyed by a conveyance roller 35 in a direction that intersects the direction of movement of the carriage 13 (e.g., an orthogonal direction indicated by the arrow A) so that the recording medium S faces an ink discharge surface of the recording head 2 and the distance to the ink discharge surface is maintained.

The recording head 2 has a plurality of nozzle arrays for discharging inks of different colors (in this exemplary embodiment, six colors of black, cyan, photo cyan, magenta, photo magenta, and yellow). As a plurality of independent liquid containers, ink tanks 1 are detachably mounted on an ink supply unit 36 and individually correspond to ink colors to be discharged from the recording head 2. The ink supply unit 36 and the recording head 2 are connected to each other with a plurality of ink supply tubes 4 corresponding to the inks of different colors. Mounting the ink tanks 1 on the ink supply unit 36 enables the inks of different colors stored in the ink tanks 1 to be supplied independently to the nozzle arrays of the recording head 2.

Each of the inks in this exemplary embodiment is a pigment ink. The pigment ink has characteristics in which resistance to light and resistance to water are both excellent, but a pigment ingredient is easy to precipitate.

A recovery unit 21 is disposed at a non-recording area, which is inside a range where the recording head 2 can reciprocate and outside a range where the recording medium S can pass so as to face the ink discharge surface of the recording head 2. The recovery unit 21 removes blockage in the nozzles by suction on a regular basis to recover the nozzles, thus forming a system that can produce a satisfactory image.

Figure 2:
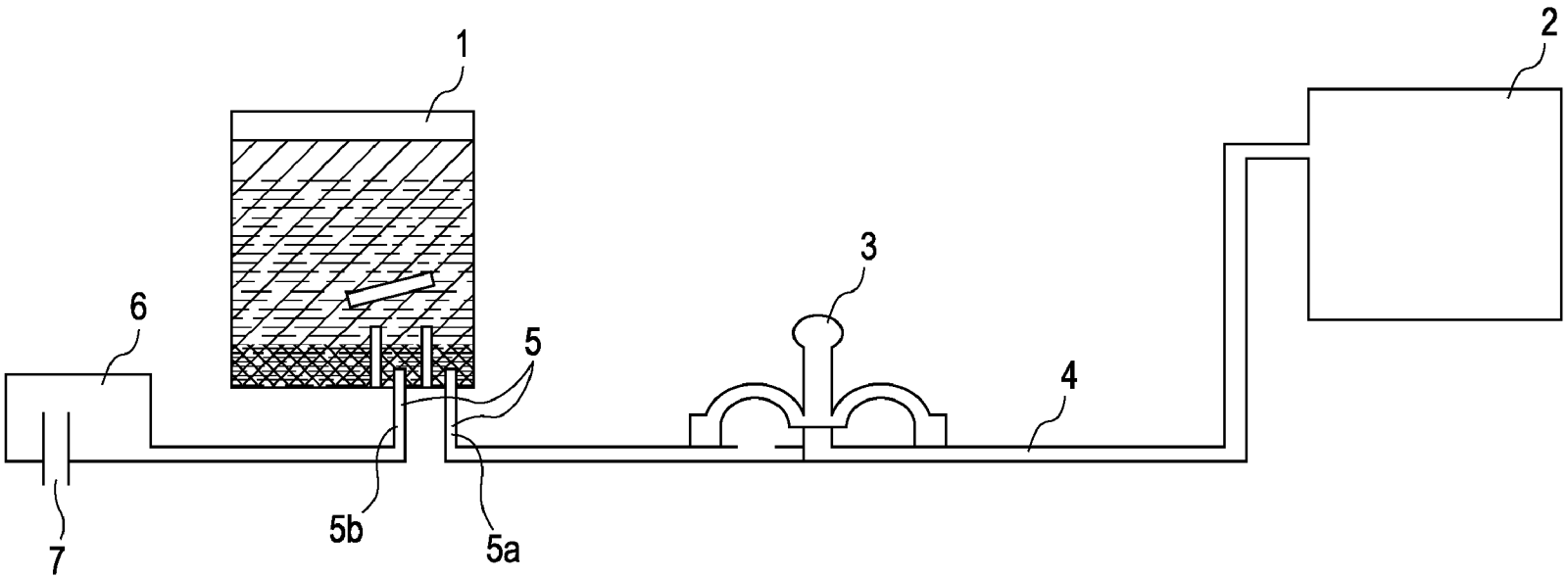
FIG. 2 is a schematic cross-sectional view of an ink supply route of an inkjet recording apparatus according to the first exemplary embodiment.

FIG. 2 is a schematic diagram of an ink supply route of a specific color according to this exemplary embodiment. With reference to FIG. 2, an ink supply structure according to this exemplary embodiment is described below.

The inkjet recording apparatus according to this exemplary embodiment includes connection ports 5 (5*a* and 5*b*) being two liquid supply tubes (hollow tubes) communicating with the ink tank 1. The first connection port 5*a* is disposed adjacent to an end of the bottom of the ink tank 1 and communicates with the recording head 2 via the supply tube 4. The ink tank 1 has a flat shape and includes a liquid storage chamber that holds the pigment ink. The ink is supplied from the ink tank 1 to the recording head 2 via the first connection port 5*a*. A rubber ink supply valve 3 is interposed in this ink supply route. Opening and closing the ink supply valve 3 using an independent driving source (not shown) can enable and disable the supply of ink to the recording head 2. The recording head 2 according to this exemplary embodiment thermally discharges ink. When the recording head 2 repeats discharging, air is accumulated within the recording head 2. If a certain amount of air is accumulated in the recording head 2, poor imaging (e.g., non-discharge) may occur. In this case, closing the ink supply valve 3, generating a closed state between the ink supply valve 3 and the recording head 2, performing suction using the recovery unit 21, generating negative pressure in the closed space, and removing accumulated air in the recording head 2 allows a satisfactory image quality to be obtained.

The second connection port 5*b* of an air introduction tube communicates with an air communication chamber 6. Air introduced from an air communication port 7 is introduced into the ink tank 1 via the second connection port 5*b*. When ink is ejected from the ink tank 1 and the internal pressure of the ink tank 1 is changed to a negative pressure, air is then introduced into the ink tank 1 from the air communication port 7. This relieves an increase in the internal pressure of the ink tank 1. When the temperature inside the ink tank 1 is increased, air inside the ink tank 1 is expanded, the internal pressure of the ink tank 1 is increased, and ink is ejected to the air communication chamber 6 from the second connection port 5*b*. In order to avoid the ejected ink from being wasted, the air communication chamber 6 has a capacity corresponding to the expansion of air inside the ink tank 1. When ink is discharged from the recording head 2 and consumed, ink accumulated in the air communication chamber 6 is first consumed, and ink in the ink tank 1 is then consumed. Therefore, in ordinary cases, the air communication chamber 6 holds no ink, gas-liquid (air-ink) exchange is performed at the bottom of the second connection port 5*b*, and a negative pressure of the recording head 2 is controlled by the head between the second connection port 5*b* and the recording head 2.

In this exemplary embodiment, the distance between the ink supply valve 3 and the ink tank 1 is set at approximately 100 mm, and the distance between the ink supply valve 3 and the recording head 2 is set at approximately 1000 mm or more. Therefore, the channel resistance from the ink supply valve 3 to the recording head 2 is set to be significantly large, as compared with the channel distance from the ink supply valve 3 to the ink tank 1. These settings allow ink corresponding to a volume change caused by the closing and opening of the ink supply valve 3 to be introduced into and ejected from the ink tank 1 with only the closing and opening of the ink supply valve 3 without an additional pump for agitating ink. Furthermore, the difference in channel resistance described above makes it possible to prevent ink from flowing in and out of the recording head 2. In this exemplary embodiment, the channel resistances from the ink supply valves 3 to the ink tanks 1 for the plurality of colors are substantially the same and are set at smaller values. This makes it possible to obtain the same amount of ink flowing in and out (the same level agitation effect) when the ink tanks 1 are arranged in any order. Conversely, the channel resistance from the ink supply valve 3 to the ink tank 1 can be changed depending on the characteristics of ink (e.g., viscosity, surface tension, and speed of precipitation). For example, the channel resistance from the ink supply valve 3 to the ink tank 1 may vary by color due to the design of the main body. In this case, an ink that is relatively resistant to precipitation can be set at a position that has a larger channel resistance (a position that produces smaller agitation effect), and an ink to be more agitated can be set at a position that has a smaller channel resistance (a position that produces larger agitation effect). In this exemplary embodiment, the volume change caused by the ink supply valve 3 is set at approximately 0.5 ml, and the amount of ink flowing in and out of the ink tank 1 in that case is set at approximately 0.45 ml. The ink supply valve 3 is linked with a cam (not shown). The speed of the closing and opening of the ink supply valve 3 is determined by the shape of the cam and the rotational speed of the cam. In this exemplary embodiment, the cam takes approximately one second to go around once. In other words, ink flows in and out of the ink tank 1 at intervals of approximately one second.

The ink tank 1 according to this exemplary embodiment is described below with reference to FIGS. 3 and 4.

Figure 3:
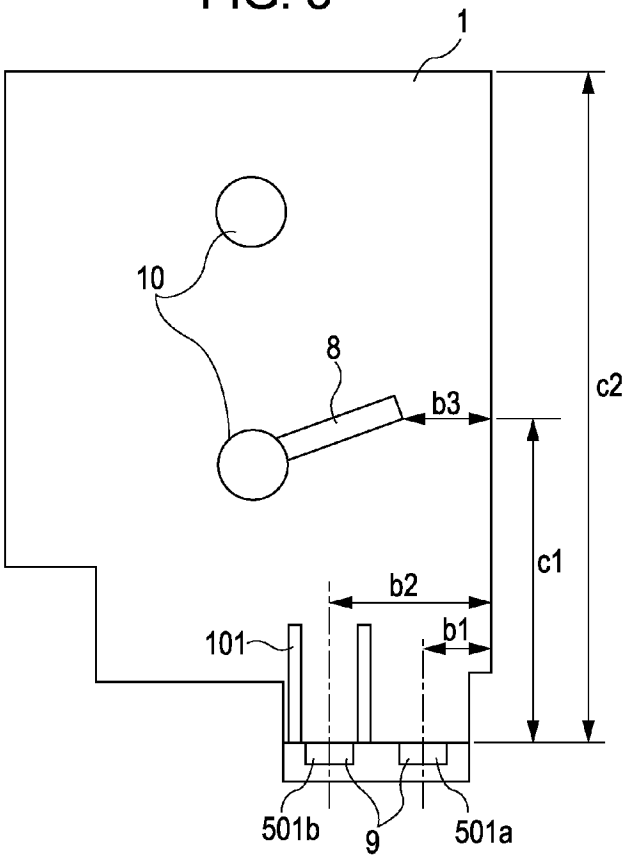
FIG. 3 is a schematic cross-sectional view of an ink tank according to the first exemplary embodiment of the present invention.

FIG. 3 is a schematic diagram of the ink tank 1 according to this exemplary embodiment. At the bottom of the ink tank 1, two connection elastic members 9 are independently disposed adjacent to one end (in the longitudinal direction in opposite faces of the ink tank). Each of the connection elastic members 9 can be formed from an elastic body (e.g., rubber). A second connection elastic member 9 is disposed at an air introduction unit 501*b* communicating with the air communication port 7, and a first connection elastic member 9 is disposed at a liquid supply unit 501*a* communicating with the recording head 2. As described above, the liquid supply unit 501*a* is located adjacent to one end of the ink storage chamber. When not attached, the ink tank 1 is sealed and the stored ink is prevented from leaking. Attaching the ink tank 1 to the inkjet recording apparatus makes connections between the ink tank 1 and the recording head 2 and between the ink tank 1 and the air communication port 7, thus forming the ink supply route. Inside the ink tank 1, adjacent to the air introduction unit 501*b* communicating with the air communication chamber 6, a cylindrical rib 101 extending upward is disposed. The cylindrical rib 101 is used to check the ink level. Specifically, in the case where the connection ports 5 of the main body are energized (for example, the first connection port 5*a* is set at a positive pole and the second connection port 5*b* is set at a negative pole), when the top surface of ink is present above the top end of the cylindrical rib 101, energization is performed via the ink. When the top surface of the ink is located below the top end of the cylindrical rib 101, electricity does not flow, and therefore, the ink level can be checked. Two circular ribs 10 (upper rib and lower rib) are independently disposed between two opposite faces of the ink tank 1 that have a maximum area. The lower circular rib 10 is provided with an overhanging rib 8. The overhanging rib 8 is also disposed between the two opposite faces having the maximum area of the ink tank 1 and restricts an upward flow of ink occurring when ink flows in and out of the ink tank 1 from the first connection port 5*a* via the liquid supply unit 501*a*. The ink tank 1 according to this exemplary embodiment has a base area of approximately 60 mm×24 mm on average and a capacity of 130 ml. In this case, the index of restriction caused by the overhanging rib 8, b3, is set at approximately 12 mm, the distance between the first connection port 5*a* and the surface of a wall, b1, is set at approximately 7 mm, and the distance between the second connection port 5*b* and the surface of the wall, b2, is set at approximately 20 mm. The overhanging rib 8 extends from the approximate center of the ink tank 1 to a region defined between the first connection port 5*a* and the second connection port 5*b* in the horizontal direction. Therefore, the overhanging rib 8 is located directly above the second connection port 5*b* but is not located directly above the first connection port 5*a*. This structure makes it possible to agitate ink more efficiently. If the index of restriction b3 is too small, the upward flow of ink is restricted, and as a result, the agitation effect is reduced. If the index of restriction b3 is too large, the upward flow of ink is distributed and decays, and as a result, the agitation effect is reduced. In this exemplary embodiment, the experimental positional relationship described above was satisfactory. The height of an end of the overhanging rib 8 above the bottom of the ink tank 1, c1, is set at approximately 43 mm, the height of the ink tank 1, c2, is set at approximately 109 mm, and therefore, the overhanging rib 8 is disposed at a position of approximately two-fifths of the overall height of the ink tank 1. If the height of the overhanging rib 8 is too large, the upward flow of ink decays before reaching the overhanging rib 8, and the agitation effect is reduced. If the height of the overhanging rib 8 is too small, the upward flow of ink is blocked (the flow is disrupted), and as a result, the agitation effect is reduced. In this exemplary embodiment, the height of the overhanging rib 8 can be set so as to be within the range of one quarter of the height of the ink tank 1 to one half thereof above the bottom thereof. The index b3 of restriction and the height c1 of the overhanging rib 8 can be set at optimal values depending on the capacity of the ink tank 1 and the amount of ink flowing in and out of the ink tank 1.

Figure 4:
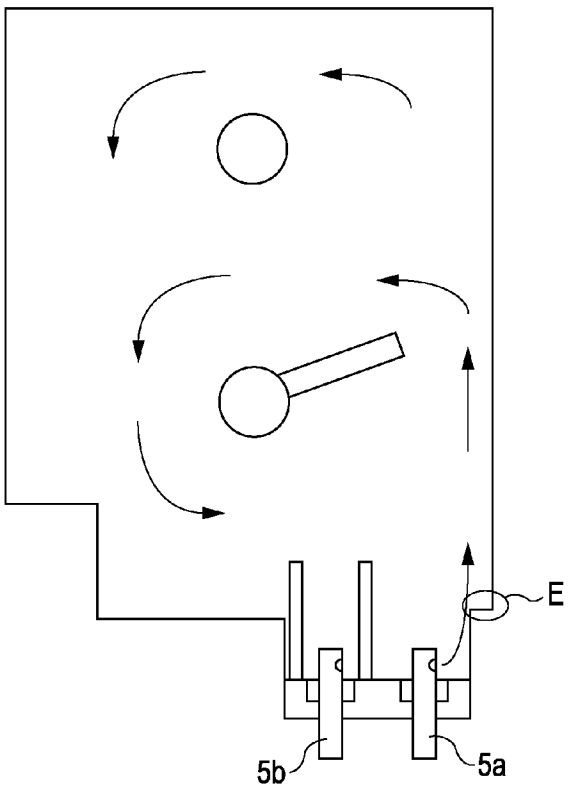
FIG. 4 is a schematic cross-sectional view for explaining a flow of ink occurring when ink is introduced in the ink tank.

FIG. 4 is a schematic diagram of the ink tank 1 illustrating a flow of ink occurring when ink flows in and out of the ink tank 1 by an action of the ink supply valve 3. Ink introduced into the ink tank 1 from the first connection port 5*a* via the liquid supply unit 501*a* flows upward and is restricted by the overhanging rib 8, thus preventing the flow of ink from being distributed and facilitating the upward flow of ink. The overhanging rib 8 extends upwardly obliquely from the circular rib 10. Alternatively, the overhanging rib 8 can have any other shape as long as the overhanging rib 8 restricts the upward flow of ink. To achieve an effect of restriction described above, the overhanging rib 8 can be disposed in a direction that intersects the vertical direction.

Figure 5:
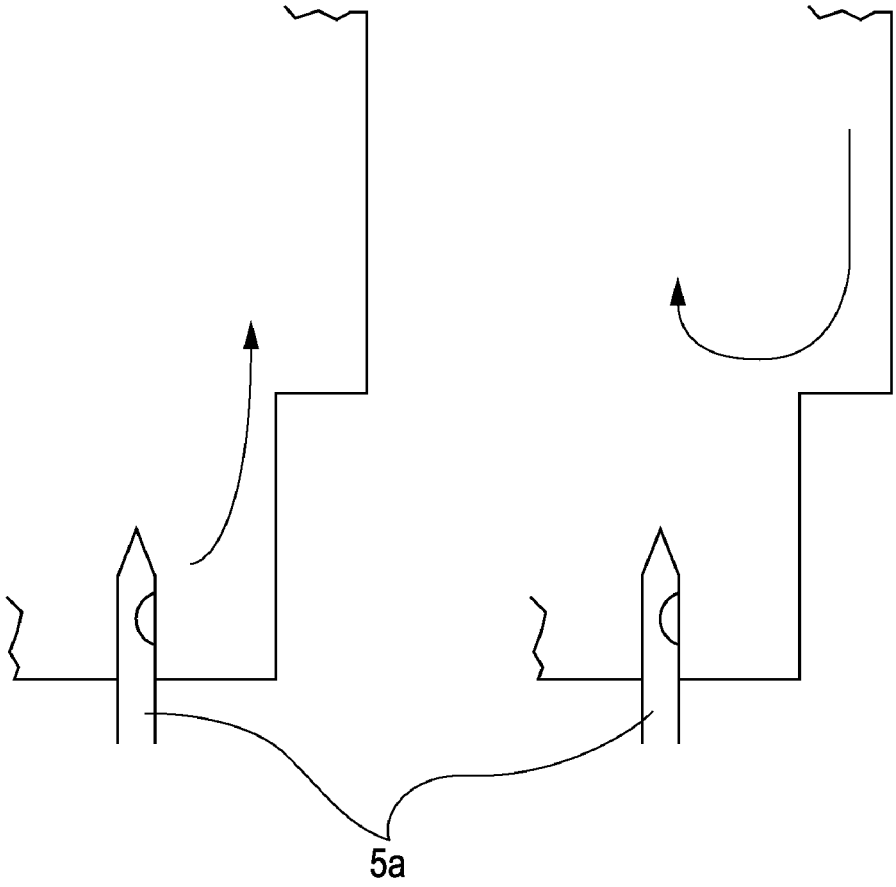
FIG. 5 is a schematic cross-sectional view for explaining a flow of ink around a connection port in the ink tank according to the first exemplary embodiment of the present invention.

A stepped edge E shown in FIG. 4 is a stepped portion in the inner face of the ink tank 1, and functions to facilitate the upward flow of ink by being disposed at a side wall adjacent to the first connection port 5*a*, as shown in FIG. 5. In other words, the edge E is shaped and located which does not block the upward flow of ink while ink flows into the ink tank 1 from the first connection port 5*a*. When ink is drawn back to the first connection port 5*a*, the edge E resists a flow of drawn ink, and the ink does not easily return. Therefore, repeating the introduction and the ejection of ink can efficiently produce a flow of ink illustrated in FIG. 4 within the ink tank 1.

A second exemplary embodiment is described below with reference to FIGS. 6A to 6E and 7.

Figure 6A:
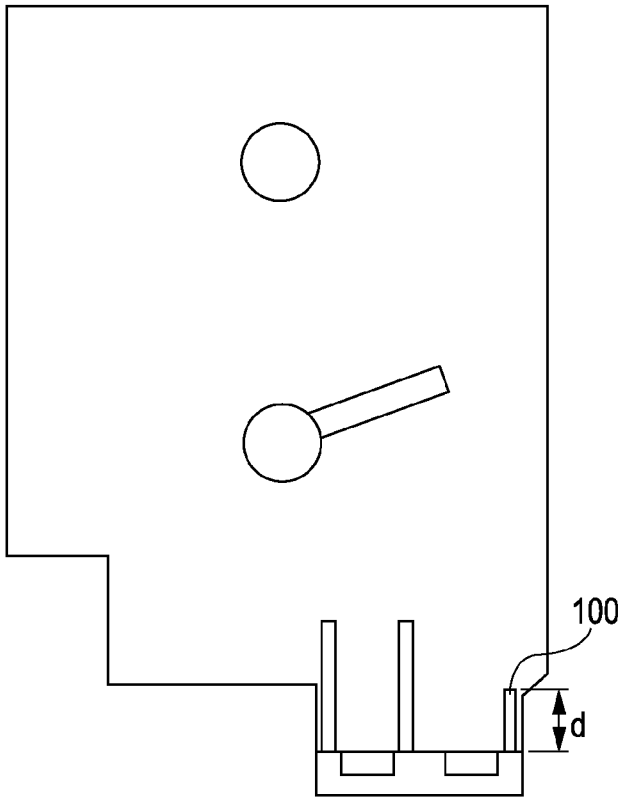
FIGS. 6A to 6C are schematic cross-sectional views of the ink tank according to a second exemplary embodiment of the present invention.
Figure 6B:
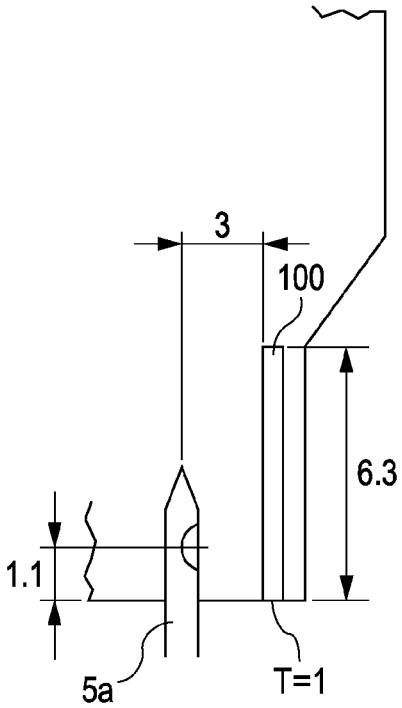
Figure 6C:
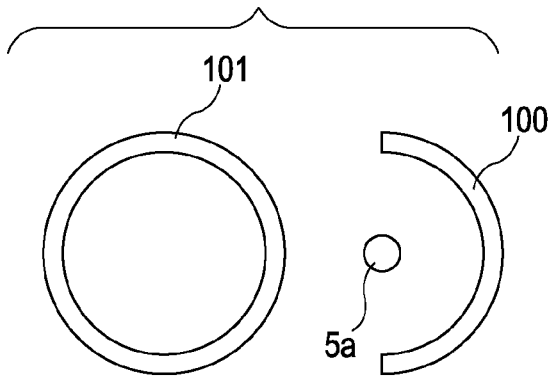
Figure 6E:
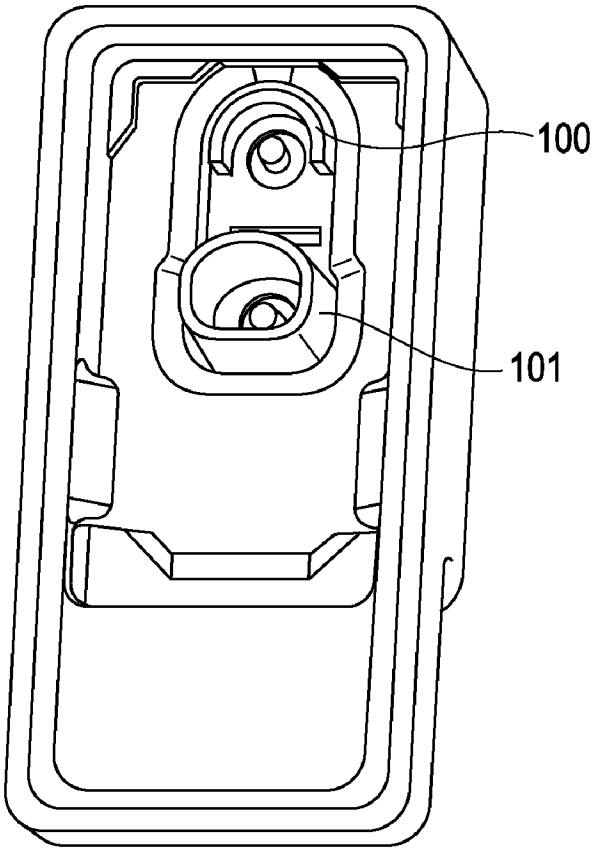
FIG. 6E is a cutaway perspective view of the ink tank according to the second exemplary embodiment.
Figure 6D:
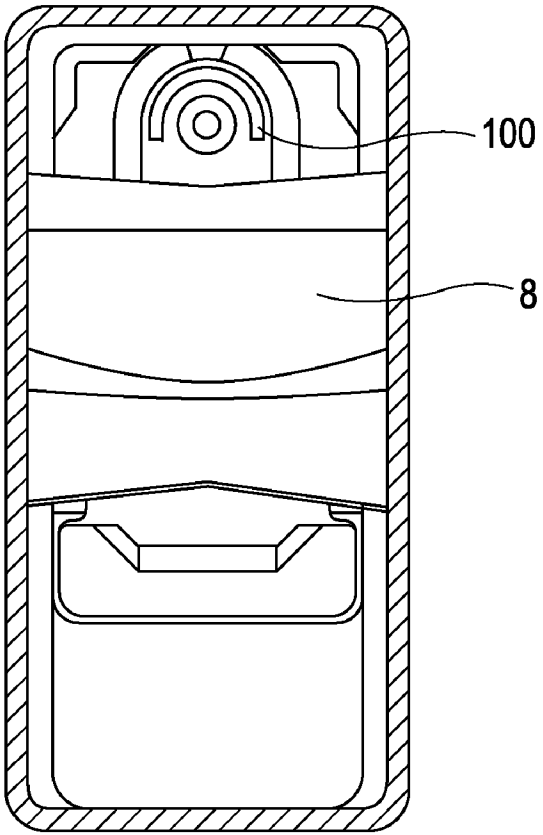
FIG. 6D is a sectional view of the ink tank according to the second exemplary embodiment.

FIG. 6A is a diagram of the ink tank in general. FIG. 6B is an enlarged view of the first connection port 5*a* and its surroundings. FIG. 6C is a schematic top view of the connection ports 5. FIG. 6D is a cross-sectional top view of the ink tank 1. FIG. 6E is a cutaway perspective view of the connection ports 5 and their soundings.

Figure 7:
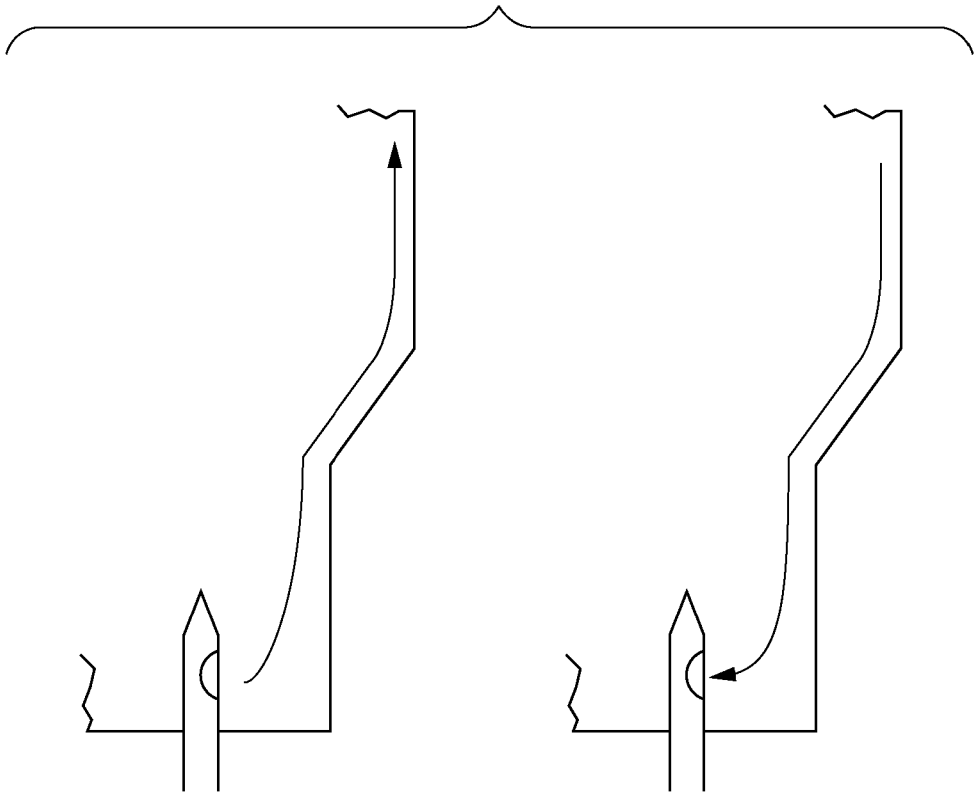
FIG. 7 illustrates schematic cross-sectional views for explaining a flow of ink around the connection port according to the second exemplary embodiment of the present invention.

The stepped edge E illustrated in FIGS. 4 and 5 can be replaced with a tapered portion illustrated in FIG. 6A. For example, the tapered portion is suited for an ink tank container formed by blow molding. In the case of blow molding, from a production process, it is difficult to produce a sharp edge. Therefore, the produced shape is inevitably gentle, as illustrated in FIG. 6A. In this exemplary embodiment, as an element acting as a unidirectional valve served by the above-described edge, a semicircular rib 100 extending upward is disposed at the bottom of the ink tank 1 about the first connection port 5*a*, as shown in FIGS. 6A to 6E. This allows the upward flow of ink to be efficiently produced by ink introduced from the first connection port 5*a*. In this exemplary embodiment, as illustrated in FIG. 6B, the semicircular rib 100 has a distance to the center of the first connection port 5*a* of 3 mm and a height of 6.3 mm. The shape of the semicircular rib 100 can be appropriately changed depending on the shape of the connection ports and their surroundings. If the semicircular rib 100 is not present, as illustrated in FIG. 7, an element functioning as a unidirectional valve is not present. Therefore, if the upward flow is produced by ink introduced from the first connection port 5*a*, a downward flow is produced when ink is ejected from the first connection port 5*a*, and as a result, the upward flow decreases.

In this exemplary embodiment, an opening of the hollow-tube first connection port 5*a* is oriented opposite the second connection port 5*b*. In other words, the opening of the first connection port 5*a* is open to a side to which the first connection port 5*a* is adjacent. A swing of the angle thereof falls within the range of ±15°. As illustrated in FIG. 6B, the distance between the center of the opening of the first connection port 5*a* and the bottom is 1.1 mm, and the opening is of an elongated circular opening having a width of 1 mm and a height of 1.5 mm. The height of the semicircular rib 100 is larger than the height of the opening of the first connection port 5*a*. Therefore, ink introduced into the ink tank 1 from the first connection port 5*a* can hit against the semicircular rib 100, thus efficiently producing the upward flow of ink.

When ink is ejected from the ink tank 1 into the first connection port 5*a*, ink present in a region opposite the opening of the first connection port 5*a* is ejected into the first connection port 5*a* to produce the upward flow of ink described above. To this end, the semicircular rib 100 is suited for a rib around the first connection port 5*a* because the semicircular rib 100 is open to the second connection port 5*b*.

As illustrated in FIG. 6D, the overhanging rib 8 is connected to sides of the ink tank 1. Therefore, ink introduced from the first connection port 5*a* to the ink tank 1 can flow upward from a gap between the overhanging rib 8 and a side of the ink tank 1 without losing energy.

Figure 8B:
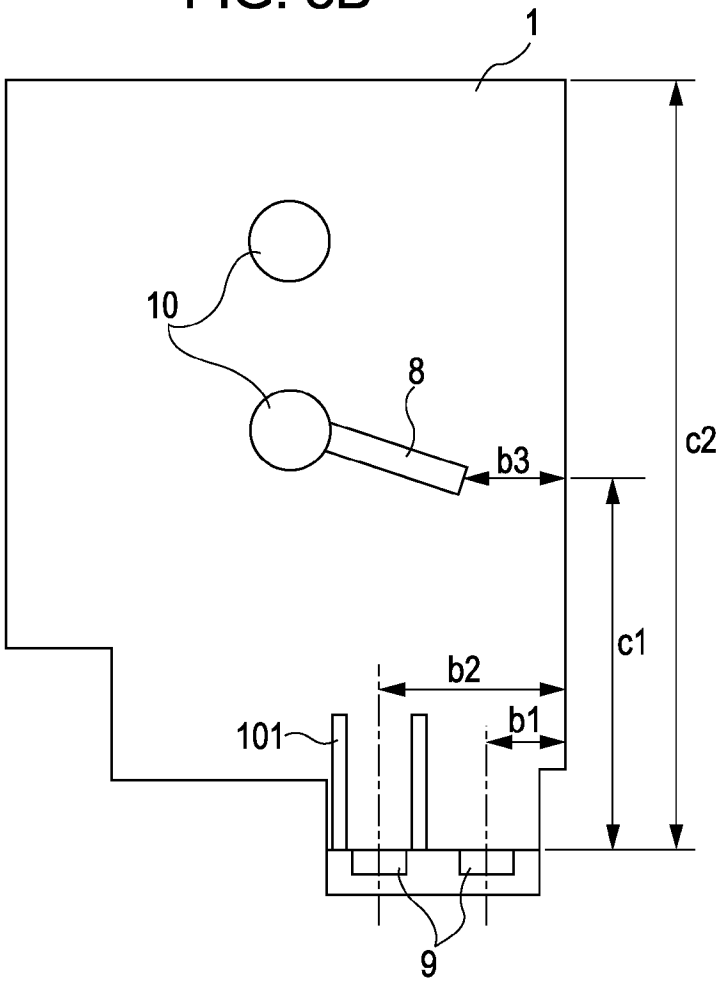
FIGS. 8A and 8B are schematic cross-sectional views of ink tanks according to other exemplary embodiments of the present invention.
Figure 8A:
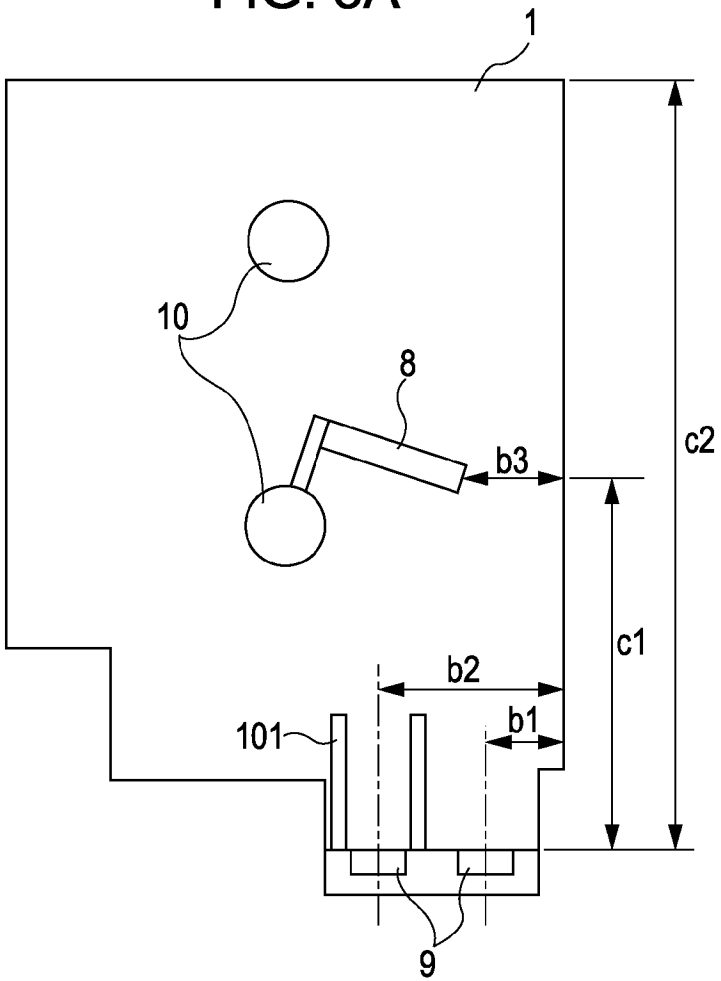
Figure 9:
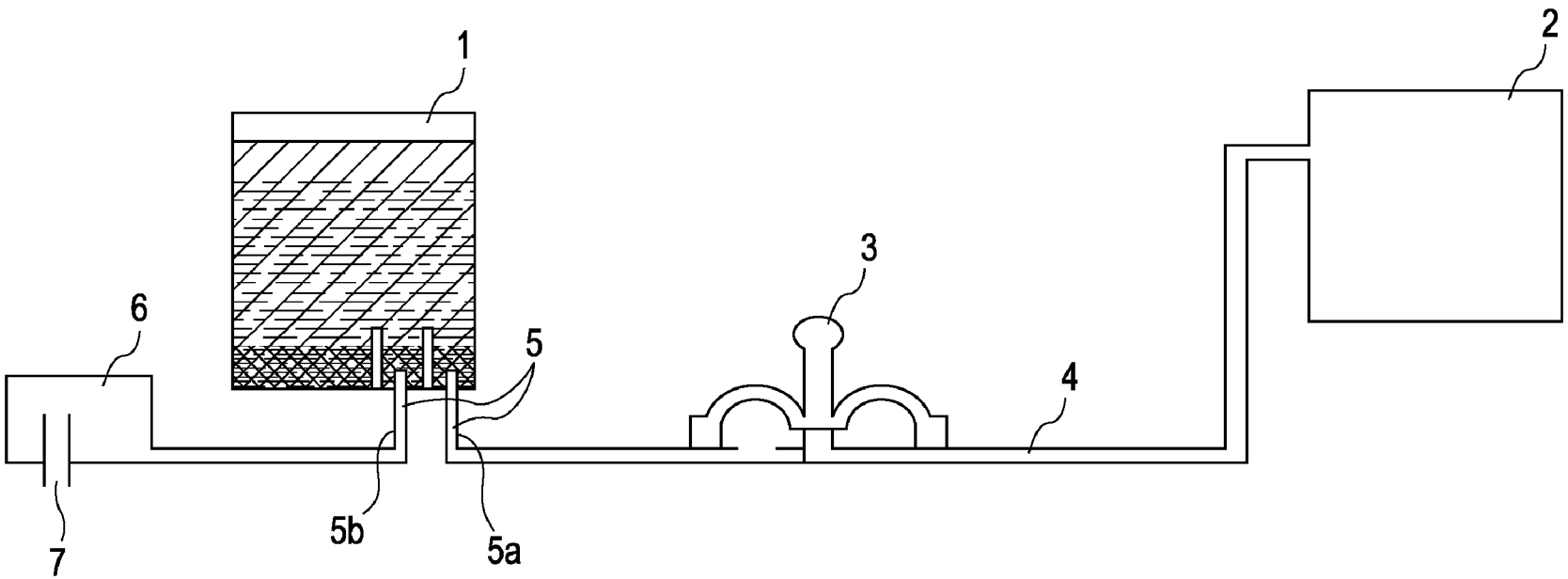
FIG. 9 PRIOR ART
FIG. 9 is a schematic cross-sectional view of an ink supply route in an inkjet recording apparatus for explaining known agitation using bubbles.
Figure 10A:
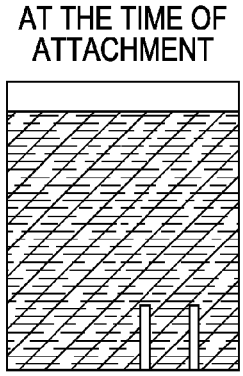
FIG. 10A PRIOR ART
FIGS. 10A to 10C are schematic diagrams of an ink tank illustrating how pigment ink precipitates within the ink tank.
Figure 10B:
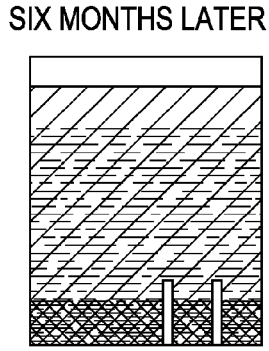
FIG. 10B PRIOR ART
Figure 10C:
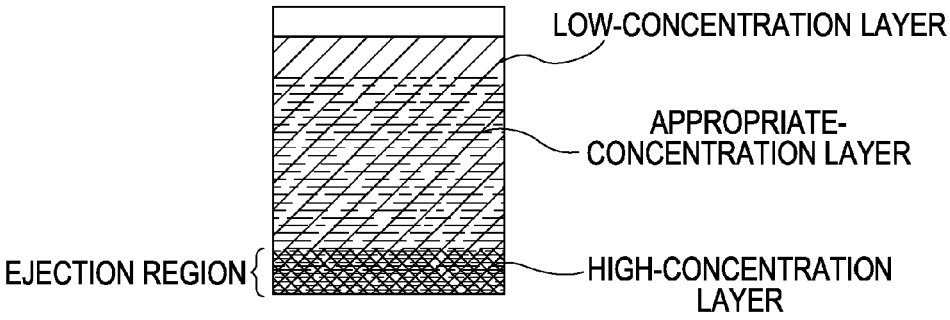
FIG. 10C PRIOR ART
Figure 11:
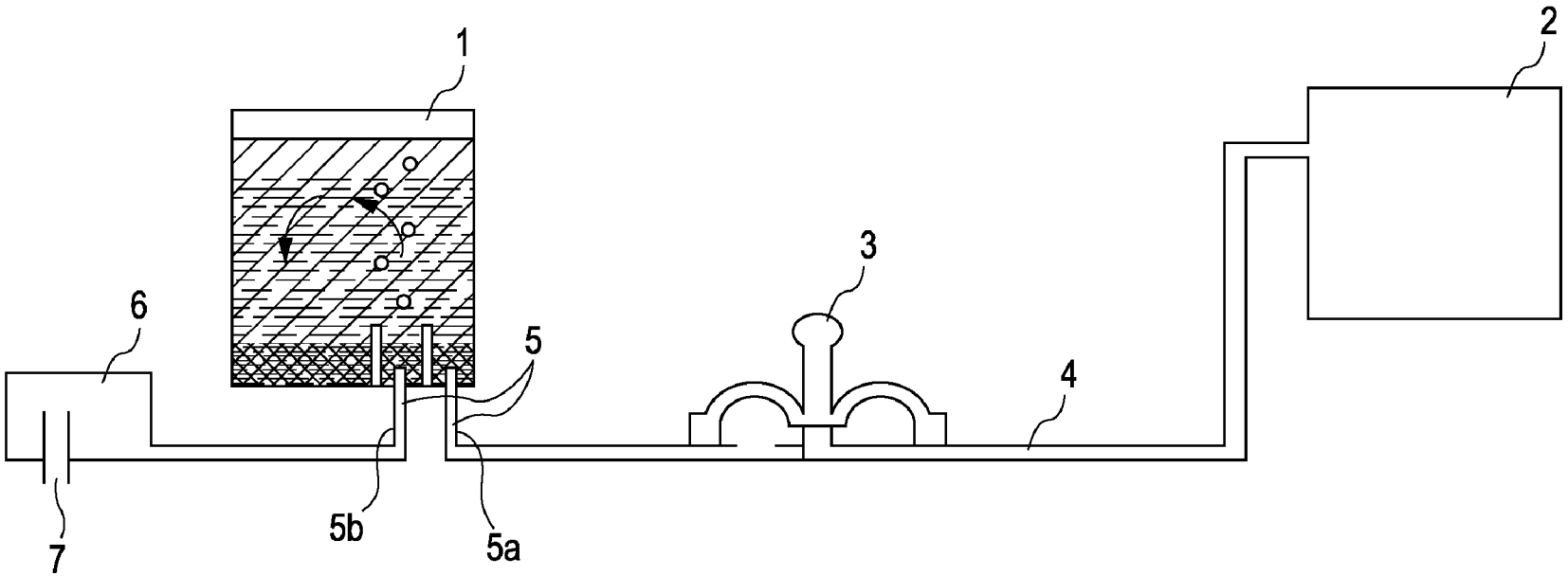
FIG. 11 PRIOR ART
FIG. 11 is a schematic diagram of an ink supply route for illustrating how known agitation using bubbles is performed.
Figure 12:
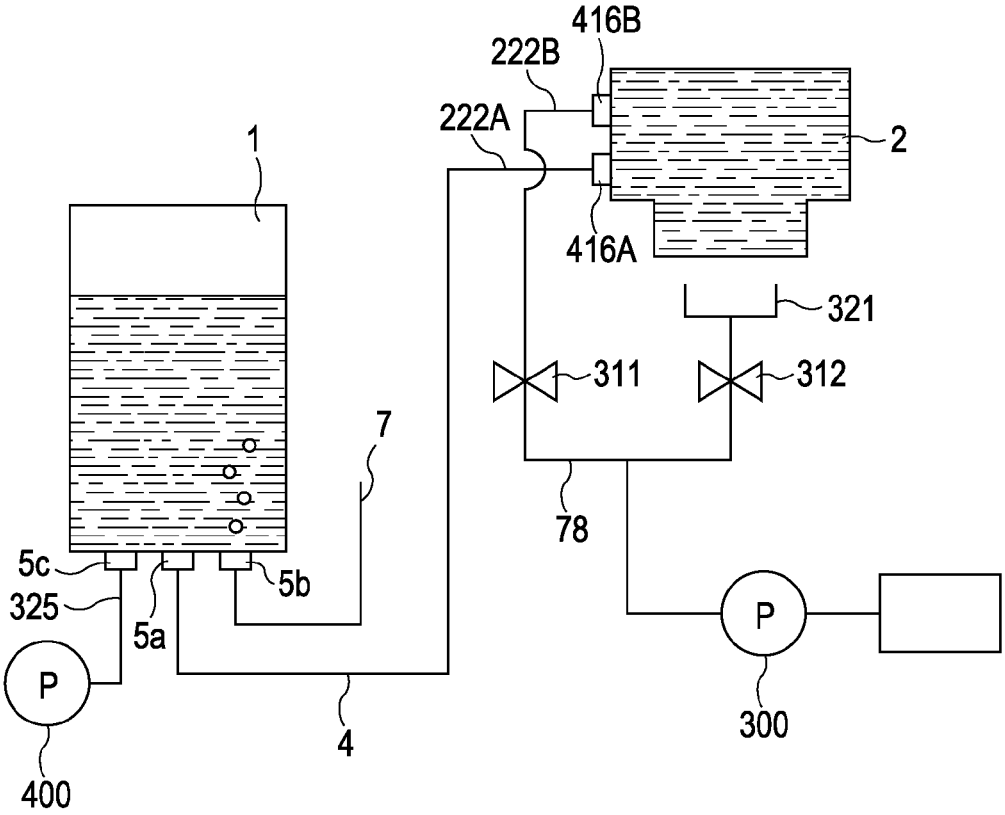
FIG. 12 PRIOR ART
FIG. 12 is a schematic diagram of an ink supply route in an inkjet recording apparatus for explaining known agitation by producing a flow of ink within an ink tank.

The ink tank 1 according to other exemplary embodiments is illustrated in FIGS. 8A and 8B. In the present invention, for the overhanging rib 8, the distance b3 to the side of the ink tank 1 and the height c1 of the overhanging rib 8 relative to the height c2 of the ink tank 1 are important. FIGS. 8A and 8B illustrate the different exemplary embodiments from the exemplary embodiments previously explained. In FIG. 8A, the overhanging rib 8 has a different slope from that in FIG. 3 and is joined to the circular rib 10. This is suited for a case in which the overhanging rib 8 is adjacent to the circular rib 10 when the ink tank 1 is formed by blow molding. In FIG. 8B, the overhanging rib 8 has a different slope from that in FIG. 3, and the circular rib 10 is displaced upward in order to obtain the same height c1 of the overhanging rib 8 as that in FIG. 3. These shapes have substantially the same agitation effect as that in FIG. 3.

As described above, there is no need to discard ink to agitate precipitated ink. Since a flow of ink is produced within the ink tank, a high-volume pump and a drive source for driving the pump are not required. Additionally, since a space for holding the ink at an air communication side is not necessary, an ink supply system that achieves efficient agitation effect while at the same time reducing the size and the cost. The provision of the overhanging rib 8 above the connection ports allows highly concentrated ink to be maintained on the overhanging rib 8. This can reduce accumulation of highly concentrated ink around the connection ports and thus reduce the amount of ink to be agitated and stirred. As a result, a good-quality image can be obtained with smaller agitation effect. In particular, the provision of the overhanging rib 8 directly above the cylindrical rib 101 can reduce accumulation of highly concentrated ink inside the cylindrical rib 101, and as a result, the highly concentrated ink is prevented from entering the air communication chamber 6. Although the inside of the air communication chamber 6 cannot be agitated, since the highly concentrated ink does not flow into the air communication chamber 6, ink supplied to the ink supply route from the air communication chamber 6 via the ink tank 1 can maintain an appropriate concentration, and a good-quality image can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-265509 filed Sep. 13, 2005, which is hereby incorporated by reference herein in its entirety.

What is claimed is:

1. A liquid container capable of being detachably mounted on an inkjet recording apparatus comprising:

a liquid storage chamber configured to store recording liquid containing pigment;

an air introduction unit disposed at a bottom of the liquid storage chamber in a state in which the liquid container is used; and a liquid supply unit disposed at the bottom adjacent to a side of the liquid storage chamber, the side not having the maximum area, and configured to let liquid flow into and out of the liquid storage chamber;

a semicircular member disposed at the bottom between the side and the liquid supply unit, a cross section of the semicircular member, being cut by a face orthogonal to a vertical direction in a state in which the liquid container is used, having the liquid supply unit as the center and being open to the liquid supply unit;

a step configured to expand the side at a position higher than the semicircular member, in a state in which the liquid container is used, outside of the liquid container, compared to the side at a position lower than the semicircular member; and a rib configured to connect a face having a maximum area of the liquid container and its opposite side, extending obliquely upward to the side in a state in which the liquid container is used, and extending from the central area of the liquid container to the front of the liquid supply unit in a horizontal direction, wherein liquid in the liquid storage chamber is stirred by flowing in and out of liquid from the liquid supply unit.

2. The liquid container according to claim 1, wherein the liquid container has a flat shape.

3. The liquid container according to claim 1, wherein the end on the side of the rib is disposed between one quarter of a height of the liquid storage chamber and one half of the height of the liquid storage chamber above the bottom of the liquid storage chamber.

4. An inkjet recording apparatus, having a recording head performing recording by discharging liquid for recording, a liquid supply tube supplying liquid to a liquid storage chamber of a liquid container, and an air introduction tube introducing air to be replaced with the supplied liquid, comprising:

a liquid storage chamber configured to store recording liquid containing pigment;

an air introduction unit disposed at a bottom of the liquid storage chamber in a state in which the liquid container is used;

a liquid supply unit disposed at the bottom adjacent to a side of the liquid storage chamber, the side not having the maximum area, compared to the air introduction unit;

a semicircular member disposed at the bottom between the side and the liquid supply unit, a cross section of the semicircular member, being cut by a face orthogonal to a vertical direction in a state in which the liquid container is used, having the liquid supply unit as the center and being open to the liquid supply unit;

a step configured to expand the side at a position higher than the semicircular member, in a state in which the liquid container is used, outside of the liquid container, compared to the side at a position lower than the semicircular member; and a rib configured to connect a face having a maximum area of the liquid container and its opposite side, extending obliquely upward to the side in a state in which the liquid container is used, and extending from the central area of the liquid container to the front of the liquid supply unit in a horizontal direction, wherein the air introduction tube is connected to the air introduction unit, wherein the liquid supply tube is connected to the liquid supply unit, wherein the liquid container is capable of being detachably mounted on an inkjet recording apparatus, and wherein liquid flows into and out of the liquid storage chamber via the supply tube disposed in a communication path, the communicating path being communicated to the liquid supply tube.

5. An inkjet recording apparatus according to claim 4, wherein a mechanism for letting liquid flow into and out of the liquid storage chamber via the liquid supply tube includes a valve for opening and closing communication of the liquid for recording in the communication path being communicated to the liquid supply tube.

6. The inkjet recording apparatus according to claim 5, wherein a channel resistance in the liquid supply tube between the valve and the liquid container is smaller than a channel resistance in the liquid supply tube between the valve and the recording head.

7. The inkjet recording apparatus according to claim 4, wherein in a state in which the liquid container is used, the height of the semicircular member is higher than the height of the liquid supply tube for performing liquid supply.

8. The inkjet recording apparatus according to claim 7, wherein the opening of the liquid supply tube is disposed on a side of the liquid supply tube, and is open to the side.

* * * * *